US005378156A

United States Patent [19]

Rohe

[11] Patent Number: 5,378,156

[45] Date of Patent: Jan. 3, 1995

[54] TEACHING AID FOR ALPINE SKIING AND METHOD OF TEACHING SKIING

[76] Inventor: John F. Rohe, 438 E. Lake St., Petoskey, Mich. 49770

[21] Appl. No.: 113,186

[22] Filed: Aug. 30, 1993

[51] Int. Cl.[6] ..... A63B 69/18

[52] U.S. Cl. ..... 434/253

[58] Field of Search ..... 434/247, 253; 482/71; 119/801, 757, 802, 803, 804

[56] References Cited

U.S. PATENT DOCUMENTS 3,014,284 12/1961 Hall ..... 434/253
4,214,382 7/1980 Matsutani ..... 434/247
5,074,795 12/1991 Clark ..... 434/253
5,120,227 6/1992 Born ..... 434/253

FOREIGN PATENT DOCUMENTS 4120813 6/1992 Germany ..... 482/71
0646335 11/1984 Switzerland ..... 482/71

*Primary Examiner*—Gene Mancene
*Assistant Examiner*—Jeffrey A. Smith

[57] ABSTRACT

A teaching aid (10) for alpine skiers is disclosed in this invention. The pupil is supported by a cradle (11) at the pupil's mid-section. The instructor controls the pupil's weight distribution and orientation to the hill by moving the cradle (11), and by maintaining eye contact and verbal communication with the pupil.

6 Claims, 1 Drawing Sheet

TEACHING AID FOR ALPINE SKIING AND METHOD OF TEACHING SKIING

BACKGROUND OF THE INVENTION

1. Field of the Invention

This invention pertains to a teaching air for alpine (downhill) skiing.

2. Description of the Prior Art

Various frames or harness arrangements have been used to teach skiing in the past. The prior art contemplates the instructor and student facing downhill. The U.S. Patent documents in the prior art are:

| Document Number | Date | Name | Class | Subclass |
|---|---|---|---|---|
| 3,014,284 | 12/1961 | Hall | 434 | 253 |
| 4,214,382 | 7/1980 | Matsutani | 434 | 247 |
| 5,120,227 | 6/1992 | Born | 434 | 253 |
| 5,074,795 | 12/1991 | Clark | 434 | 253 |

Foreign Patent Documents:

| Document Number | Date | Country | Name | Class | Subclass |
|---|---|---|---|---|---|
| 0,646,335 | 11/1984 | Switzerland | Groux | 482 | 71 |
| 4,120,813 | 6/1992 | Germany | Gerndt | 482 | 71 |

SUMMARY

Downhill skiing involves weight distribution and movements unlike those experienced when walking or running. Communicating these concepts to a student skiier requires strong communication skills and intense concentration by the student. Young children are readily distracted by other activities on the ski slope. Ideally, this student would be taught by a method in which eye contact is facilitated (to minimize distractions elsewhere), visual and verbal commands are readily communicated and the student's weight distribution and orientation to the hill are physically imparted by the instructor. The existing prior art does not enable an instructor to maintain this degree of mental and physical control over the student skiier.

This invention enables the instructor to maintain visual eye contact with the pupil while physically controlling the pupil's movements. The instructor skis backwards, while confronting the downhill skiing student. A cradle resting against the student's mid-section is controlled by the instructor. The student's hands may grasp handles which simulate the grip on a ski pole. As the student gains confidence, the instructor may introduce a level of independence by gradually pulling the cradle away from the student's mid-section, thereby enabling the student to duplicate the motions previously influenced by the instructor's use of the cradle.

BRIEF SUMMARY OF THE INVENTION

A teaching aid (10) for alpine (downhill) skiing is disclosed. The invention facilitates direct verbal communication and eye contact between the teacher and the pupil, while enabling the teacher to physically support the pupil in a proper orientation to the downhill slope for teaching stopping and turning skills.

DESCRIPTION OF THE PREFERRED EMBODIMENTS

This invention relates to a leaning and teaching aid (10) for alpine skiing. The principal objects of the invention are to provide a convenient means for supporting a student skier, to physically assist the student in maintaining proper orientation to the hill and to facilitate eye contact and direct verbal communication with the student. Other features of the invention are simplicity and economy of construction, efficiency and dependability of operation, and adaptability to skiers of differing ages, weight and height. The invention is most suitably adapted to the young learner.

The sequence of teaching skiing skills typically begins with the snowplow stop and the snowplow turn. Mastery of a fundamental snowplow is essential to the evolution of skiing ability. Eventually the skier graduates to a parallel turn. In the snowplow, a skier's shoulders should remain perpendicular to the fall line (i.e. the course a ball would fall when rolling straight down the hill), the skier's weight should predominantly be on the downhill skiing while negotiating a turn, shoulders should remain horizontal, hands in front, poles aiming rearward and down, knees must be bent, the hip should be oriented uphill, while the shoulders and forearms are directed downhill. Efforts to master these numerous skills are particularly frustrating when the new skier first finds a pair of lengthy skis cumbersome and awkward. The need for effectively communicating these skills is generally the greatest when one is working with a young pupil. It is not uncommon to find pupils learning to ski at approximately the same time they are learning to walk. The ability to maintain eye contact and direct voice communication with the pupil is particularly helpful in maintaining the pupil's attention.

Figure 1:
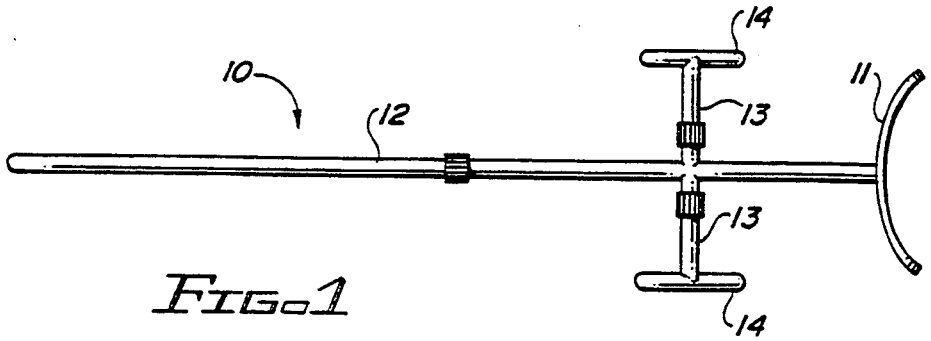
FIG. 1—A top view of the teaching aid (10) embodying the present invention.
Figure 2:
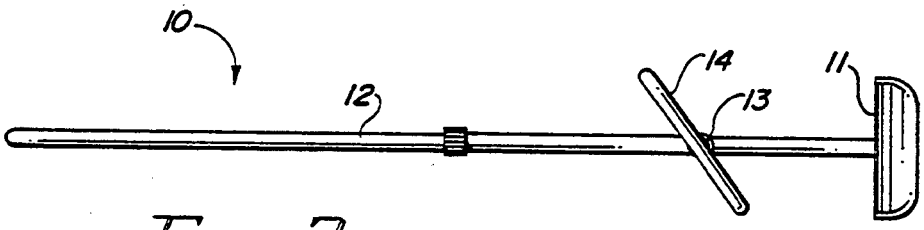
FIG. 2—A side view of the invention shown in FIG. 1.
Figure 3:
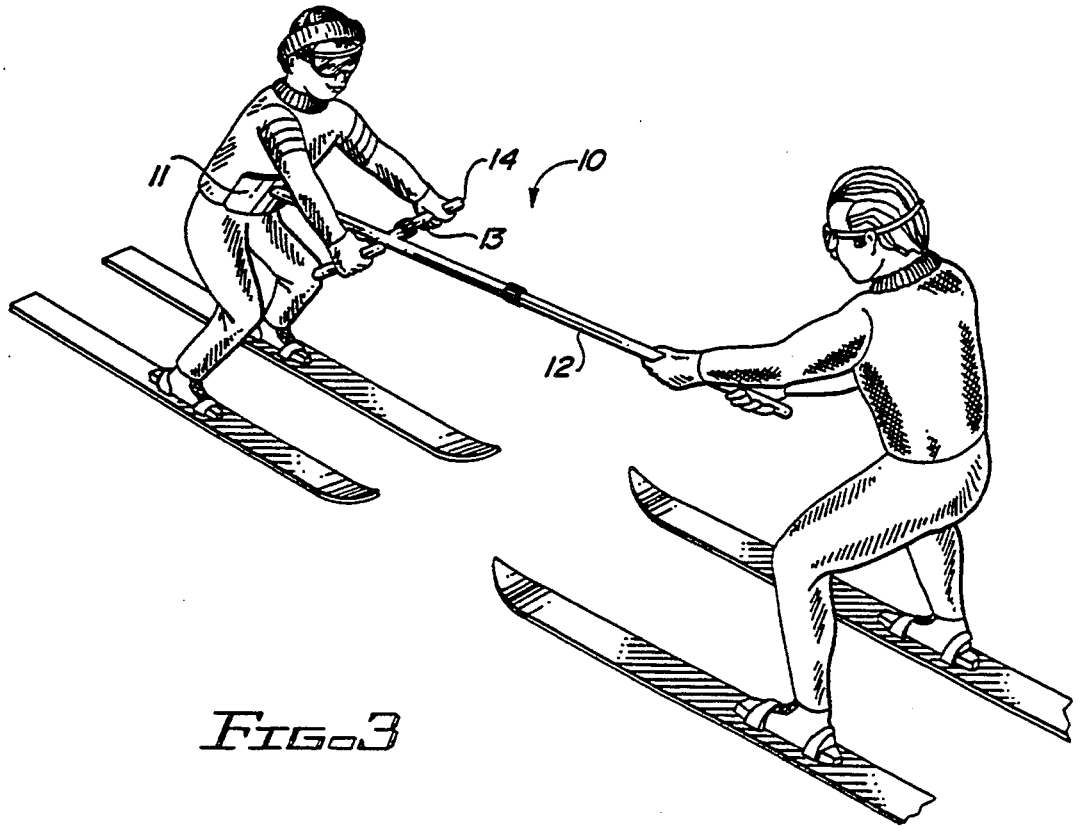
FIG. 3—A sketch of a skier cradled by the alpine skiing teaching aid (10).

With the preceding objects in mind, a teaching aid (10) is depicted in FIGS. 1 and 2. During downhill instruction, the pupil's mid-section is braced by the cradle (11), while the student grasps either the beam (12) or opposite sides of the arm (13). In an improved embodiment of the invention, the pupil may grasp handles (14) on opposing ends of the arm (13). The handles (14) are disposed in an angle similar to that of a skier's ski poles (downward and rearward at approximately 45 degrees). A pupil supported by the cradle (11) is depicted in FIG. 3. The instructor, skiing backwards downhill, holds the other end of the beam (12), while facing the pupil. By maneuvering the beam (12) and cradle (11), the instructor can control the pupil's orientation to the hill and weight distribution. Security is therefore imparted to the student who would otherwise have an awkward skiing experience.

In understanding the fundamentals of a snowplow, the teaching aid (10) enables the student to feel comfortable while facing downhill, knees bent, shoulders and forearms downhill, hip uphill, hands forward, as if holding ski poles, shoulders horizontal and with the assurance of the instructor facing the pupil. The direct visual contact with the pupil affords an ability to verbally communicate directly with the pupil.

The teaching aid (10) is particularly helpful in mastering fundamental turning skills. Learning to bear weight on the "downhill ski" (i.e. the ski on the outer circumference of the ram), while maintaining shoulder orientation perpendicular to the fall line, hip pointing uphill, hands forward, shoulders horizontal, shoulders and forearms downhill during the come of the turn is a particular challenge for a new skier still struggling with the cumbersome experience of wearing skis. Any effort to shout these multiple instructions from the rear or side is frustrating to instructor and pupil.

The snowplow turn (and even the subsequent parallel turn) is accomplished by shifting the skier's weight to the downhill ski. With the teaching aid (10), the instructor is able to direct the pupil's hip and weight to the downhill ski. While the pupil is supported by the cradle (11), the instructor my move the pupil's hip onto the left ski, thereby shifting weight to the left by manipulating the beam. The instructor holds the beam (12) parallel with the fall line. This causes the pupil's shoulder to remain perpendicular to the fall line since grasping the arm (13) or handles (14) causes the pupil's forearms continue to point in the direction of the fall line. By placing weight on the left ski, the pupil is caused to negotiate a turn to the pupil's right. After completing that turn, the instructor can cause the pupil's hip to be shifted to the right by manipulating the beam (12), thereby enabling the pupil to negotiate a left turn. During the entire exercise, the instructor can adjust the height of the cradle (11) to influence the pupil's knee bending. Any tilt in the pupil's shoulders can be counteracted by rotating the beam (12) and cradle (11).

The instructor repeats the exercise of shifting the pupil's weight from the fight to the left, and back to the right in prompting a series of turns while proceeding downhill. With this teaching aid (10), the instructor is liberated from the necessity of reminding the pupil to "keep your shoulders downhill", "keep your weight on the downhill ski", "keep your hip uphill", "hands in front", "aim your poles back", "don't tilt", "remember to bend your knees", "keep your hands in front of you", etc. The instructor can simply inform the pupil to notice that as their weight is shifted from one side to the other by the beam (12), they are caused to negotiate a series of turns. The instructor can also point out that the pupil's forearms and shoulders are in the proper form by pointing downhill. Instead of the incessant reminders to bend the knees, the instructor can simply have the pupil notice how comfortable the influenced knee bend feels.

The teaching aid (10) provides the very young pupil an opportunity to master skills even before they are able to fully comprehend the instructor's verbal messages.

As the skier's skills improve, the instructor can gradually cause the student to become less dependent upon the teaching aid (10) by pulling the aid away (i.e. downhill) from the pupil. This causes the pupil's weight to be supported on the pupil's skis, rather than on the cradle (11). This pupil could still grasp the arm (13) or handle for purposes of supporting a proper orientation for shoulders and forearms.

In an improved embodiment of the invention, the beam (12) can be telescoped to varying lengths. Similarly, to accommodate skiers of differing shoulder widths, the arm (13) can also be telescoped to differing lengths. The telescoping feature is not depicted in the drawings as conventional means of telescoping the beam (12) and arm (13) could be employed.

In an improved embodiment of the invention, an adjustable strap is affixed to opposite ends of the cradle (11). This strap wraps around the back of the pupil. In case the student becomes unstable, this strap provides an extra measure of support. In most cases, the skier's weight on the cradle (11) would obviate the necessity of a strap. The strap could also be helpful in lifting the skier after a fall. A variety of conventional straps are conventionally available, and accordingly, the strap is not depicted in the drawings.

I claim:

1. A method by which an instructor teaches skiing to a pupil, the method comprising the steps of:

a. the instructor skiing backwards down a hill while confronting a downhill-facing pupil;

b. the pupil resting his or her midsection against a cradle which is affixed to a beam having a longitudinal axis, the beam being controlled by the instructor;

c. the pupil grasping handles attached to ends of an arm, the arm being attached to the beam at an angle perpendicular to the longitudinal axis of the beam, and each of the handles being attached to an opposite end of the arm at an angle perpendicular to the arm; and d. the instructor manipulating the beam to influence the weigh distribution of the pupil, the orientation of the pupil to the hill, and the posture of the pupil.

2. A method by which an instructor teaches skiing to a pupil, the method comprising the steps of:

a. the instructor skiing backwards down a hill while confronting a downhill-facing pupil;

b. the pupil resting his or her midsection against a cradle which is affixed to a beam, the beam being controlled by the instructor; and c the instructor manipulating the beam to influence the weigh distribution of the pupil, the orientation of the pupil to the hill, and the posture of the pupil.

3. A teaching aid for alpine skiing comprising:

a. a beam having a longitudinal axis;

b. a cradle against which a student skier may be positioned, the cradle being affixed to one end of the beam perpendicularly to the longitudinal axis of the beam; and c. a telescoping arm extending perpendicularly to the longitudinal axis of the beam and being affixed to the beam.

4. The teaching aid of claim 3, further comprising a handle affixed to each of first and second ends of the arm, the arm having a longitudinal axis and each handle extending perpendicularly to the longitudinal axis of the arm.

5. The teaching aid of claim 4, wherein each handle has a longitudinal axis, the longitudinal axis of each handle being disposed in a plane which is substantially parallel to a plane occupied by the longitudinal axis of the beam and wherein the longitudinal axis of each handle is disposed at an angle relative to the longitudinal axis of the beam of approximately forty-five degrees.

6. The teaching aid of claim 3, wherein the beam is a telescoping beam.

* * * * *